US005636945A

United States Patent [19]

Nes

[11] Patent Number: 5,636,945

[45] Date of Patent: Jun. 10, 1997

[54] ROCKBOLT

[76] Inventor: Oddbjörn Nes, Fjellvelen 10, N-6100 Volda, Norway

[21] Appl. No.: 397,126

[22] PCT Filed: Aug. 24, 1993

[86] PCT No.: PCT/NO93/00129

§ 371 Date: May 1, 1995

§ 102(e) Date: May 1, 1995

[87] PCT Pub. No.: WO94/05900

PCT Pub. Date: Mar. 17, 1994

[30] Foreign Application Priority Data

Sep. 9, 1992 [NO] Norway ..... 923497

[51] Int. Cl.[6] ..... E21D 21/05

[52] U.S. Cl. ..... 405/259.1; 405/259.5

[58] Field of Search ..... 405/259.1, 259.4, 405/259.5, 269

[56] References Cited

U.S. PATENT DOCUMENTS 4,140,429 2/1979 Herbst .
4,655,644 4/1987 Lane et al. .
4,832,534 5/1989 Duvieusart .
4,992,004 2/1991 Haug ..... 405/259.5
5,375,947 12/1994 Gouws et a. ..... 405/259.5

FOREIGN PATENT DOCUMENTS 323657 9/1971 Austria .
A1 3204417 8/1983 Germany .

*Primary Examiner*—William P. Neuder
*Attorney, Agent, or Firm*—Chilton, Alix & Van Kirk

[57] ABSTRACT

Device for fastening of a rockbolt (12) in a hole (11) in rock, provided with an expansion bushing (14) at the inner end. At the outer end of the rockbolt, a washer like pressure member (18) is arranged to press against the rock (19), with a nut (16). The rockbolt (12) is provided with a tube (23) extending over at least the greater part of its free length, and is provided to supply cementing grout to the inner end of the rock hole and expelling of air from the rock hole. The tube is preferably connected to transfer cementing grout through the annular passage created in the tube.

2 Claims, 1 Drawing Sheet

ROCKBOLT

BACKGROUND OF THE INVENTION

The invention relates to a device for mounting rockbolts.

When permanently safeguarding with rockbolts, e.g. in tunnels, corrosion protection is required. To achieve this, the bolt may be completely moulded by injecting cementing grout or by "cement grouting". The bolts are usually hot galvanized or powder painted.

It is desirable to combine the use of bolts utilized for making a work place safe, without any requirement for corrosion protection, and the succeeding cementing to increase the fastening and establish protection against corrosion.

To achieve this, tube shaped bolts with an expansion bushing at the inner end have been used. This solution to the problem allows later cementing, but is expensive because the cost of tube bolts is approximately twice that of steel bolts. Additionally, this solution is sensitive to incorrect grout consistency.

It has been proposed to after treat steel rods with a cementing hose and a venting tube. A steel rod is fastened at its inner end with an expansion bushing or a plastic grouting, e.g. a polyester cartridge. Additionally a venting tube is introduced to the bottom of the hole and a cementing hose is introduced approximately 25 cm into the hole. The outer part of the hole is then sealed with sealing foam, before introducing of cementing grout. The air in the hole will then expel through the venting tube.

This cementing requires additional mounting time and is impaired by bad sealing with the sealing foam. This results in leakage before the hole is filled and a part of the bolt not being covered by cementing grout.

SUMMARY OF THE INVENTION

The main object of the invention is to provide a device for fastening rockbolts, which may be used more quickly and with less expensive equipment than has been the case with known methods. Further, it has to ensure a sufficient quality and safety of the fastening to avoid damages due to bolt deficiency caused by bad fastening. It is a particular object to provide a fastening method giving lasting corrosion protection, to increase the longevity and safety of the bolt.

To practice the invention, only an inexpensive and easily mounted tube is required. This tube can be manufactured quite inexpensively from plastic and can be easily mounted on the rockbolt in advance of or at mounting in the rock, i.e. at the front of a tunel during blasting work. The device will thus be prepared for later cementing with grout or other cementing mass to ensure fastening of the rockbolt and corrosion protection. In this way, rapid insertion of the rockbolt as protection during the work is achieved, and the expansion bushing at the inner end of the rockbolt can be loaded. It is then possible to make a rapid pressurised introduction of cementing grout, as the tube will ensure a complete evacuation of air from the rockhole and a corresponding introduction of cementing grout to thereby provide the required protection.

The tube can be secured to the support element in different ways and be manufactured from different materials and in different shapes, as stated in the independent claims and in the description of the examples.

BRIEF DESCRIPTION OF THE DRAWINGS

The invention in one embodiment is described in more detail with reference to the drawings, in which.

DESCRIPTION OF THE PREFERRED EMBODIMENT

Figure 1:
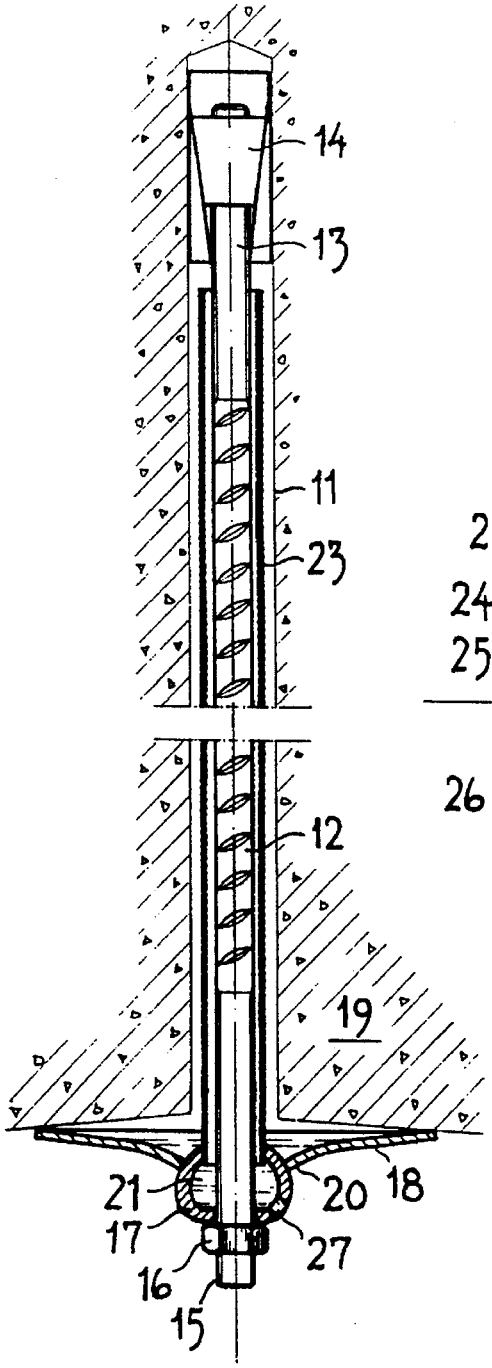
FIG. 1 is an axial section and FIG. 2 shows in larger scale detail of the outer end of the device of FIG. 1.

In FIG. 1 there is shown a rockhole 11 with a rockbolt 12 of steel with which is threaded 13 on the inner end and on which an expansion bushing 14 is mounted. The outer end is threaded 15 with a nut 16 thereon. Under the nut 16 is a spherical support or pressure element 17, (in the following denominated "pressure sphere") defining a convex wall or surface, thrust against a washer element 18 on the rock wall 19 around the hole 11. The washer element 18 has an upwardly curved flange 20 along the rockwall toward the rockhole. This flange is adjacent the inner part of the pressure sphere 17.

Figure 2:
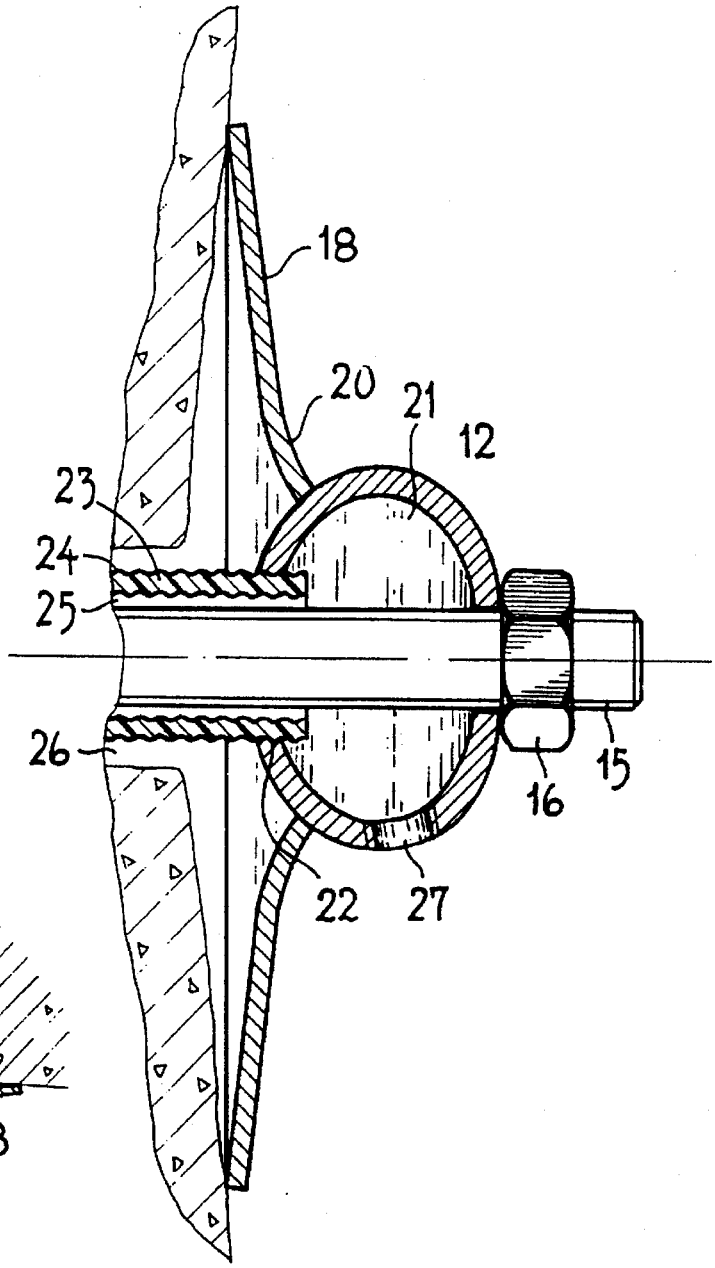

The pressure sphere 17 which is shell shaped has an inner cavity 21 and an opening 22 facing the rock with a clearance to the bolt 12. The opening 22 is made for fitting a tube 23 extending over the exposed part of the rockbolt, toward the expansion bushing 14. In the shown embodiment shown the opening 22 is threaded to engage external threads 24 on the tube 23 (FIG. 2).

The tube 23 is sized to form an annular passage 25 around the rockbolt 12. The drilled hole 11 is correspondingly sized to allow for an annular passage 26 outside the tube 23. The object of said annular passages or channels will be described in the following functional description.

The outer part of the pressure sphere 17 is provided with an opening 27, which is preferably threaded or converging slightly toward the center. This opening allows for threading or interference fitting of a pipe end (not shown) to attach an inlet hose or pipe for cementing grout or another cementing mass.

The rockbolt 12 with the tube 23 and the expansion bushing 14 mounted thereon can be readily introduced in a rock hole to establish an intermediate anchoring by thightening the nut 16 to expand the expansion bushing 14.

At a later time, an inlet pipe can be fitted to the opening 27 of the pressure sphere 17 and cementing grout can be pumped into the cavity 21 of the pressure sphere 17 and from there through the annular passage 25 of the tube 23. Cementing grout will penetrate through the tube and expel air from the tube and start the filling of the annular channel 26 from the inner end. In this manner, air will be expelled from the rock hole and all voids will be filed with cementing grout, without risk of air pockets or corrosion due to ecentricity of the rockbolt in the pipe, by bad sealing to the plastic tube.

In the example shown the tube 23 is manufactured, for example from plastic, with inner and outer threads. Tubes of other materials and with other kinds of corrugations can however be used. As an alternative to the threaded connection to the pressure sphere 17, the pressure sphere can be clamped on a tube with some kind of corrugation. A clamping or other form of anchoring with heat treatment or cementing between the tube 23 and the pressure sphere can also be utilized. It is required that there be a sufficiently strong connection to withstand the handling during introduction in the rockhole 11.

Instead of the pressure sphere 17 there can be a divided pressure element having a lower part with a spherical face to abut the washer element 18 and a dish shaped upper part. The tube 23 can be terminated with a stud to be introduced through an opening in the dish shaped upper part. Thus the pressure element is not needed as a transfer element for cementing grout.

As an alternative to pumping cementing grout through the tube, the connection of the supply can be made to pump cementing grout into the outer passage, to expel air through the tube, which will be filled from the inner end.

I claim:

1. Device for fastening of a rockbolt (12) in a hole (11) in rock, provided with a fastening member, particularly an expansion bushing (14) on a threaded part (13) at the inner end, and at the outer end of the rockbolt a washer like pressure member (18) to press against the rock (19), with a nut (16) on the outer threaded part (15) of the rockbolt, to press against a support element (17) with an opening for supply of cementing grout for filling the cavity between the rockbolt and the rock, to increase the fastening thereof and provide corrosion protection, wherein the rockbolt (12) is provided with a tube (23) extending over at least the greater part of its free length, said tube being provided to supply cementing grout to the inner end of the rockhole, characterized in that the support element (17) has at least a partly spherical wall defining a convex abutment against the pressure member (18) and an inner space for receiving a supply of cementing grout through a hole (27) in the wall.

2. Device according to claim 1, characterized in that the support element (17) is of spherical shell form and has a threaded opening (21) for the pipe (23). the pipe being provided with an outer thread at least at the outer end, and that the support member has a hole (27). which may be threaded, for introduction of cementing grout.

* * * * *